United States Patent [19]

Davis et al.

[11] Patent Number: 4,509,727

[45] Date of Patent: Apr. 9, 1985

[54] OFF-GAS MONITOR FOR STEEL PROCESSES

[75] Inventors: Kevin M. Davis; Timothy M. Wahl, both of Rochester; John A. Beckman; Karl J. Isele, Jr., both of Canton, all of Mich.

[73] Assignee: Nalco Chemical Company, Oak Brook, Ill.

[21] Appl. No.: 497,360

[22] Filed: May 23, 1983

[51] Int. Cl.[3] ..... C21B 7/22

[52] U.S. Cl. ..... 266/44; 55/270; 73/28; 75/25; 75/41; 266/79; 266/157; 266/99

[58] Field of Search ..... 75/41, 42, 25; 266/44, 266/157, 99; 422/78; 73/28, 863.23; 55/270

[56] References Cited

U.S. PATENT DOCUMENTS

| | | | |
|---|---|---|---|
| 3,667,191 | 6/1972 | Prince et al. | 55/87 |
| 3,880,620 | 4/1975 | Lange et al. | 55/72 |
| 4,158,562 | 6/1979 | Mattioli et al. | 75/41 |

*Primary Examiner*—M. J. Andrews

*Attorney, Agent, or Firm*—John G. Premo; Robert A. Miller; Donald G. Epple

[57] ABSTRACT

A blast furnace off-gas sampling apparatus comprising a valved sample line for continuously withdrawing a sample off-gas from an off-gas line, pressure and temperature sensing means for determining the pressure and temperature within the sample line and pressure filter means attached to the sample line for removing particulate matter from the off-gas going through the sample line, and:

A method for determining gas scrubber efficiency in steel mill furnace off-gas systems which comprises the steps of:

(a) Withdrawing a side stream sample from untreated gas flowing through an off-gas line, (b) passing said sample through a pressure filter for a fixed period of time whereby the particulate matter in the sample is collected, (c) withdrawing a side stream sample from the same off-gas line after chemical treatment has been added to the off-gas and passing the treated sample through a pressure filter for the same fixed period of time used in step (b), whereby the particulate matter in the treated matter is collected.

(d) comparing the amount and types of samples collected in steps (b) and (c) to determine the efficiency of the treatment.

1 Claim, 1 Drawing Figure

OFF-GAS MONITOR FOR STEEL PROCESSES

INTRODUCTION

Figure 1:
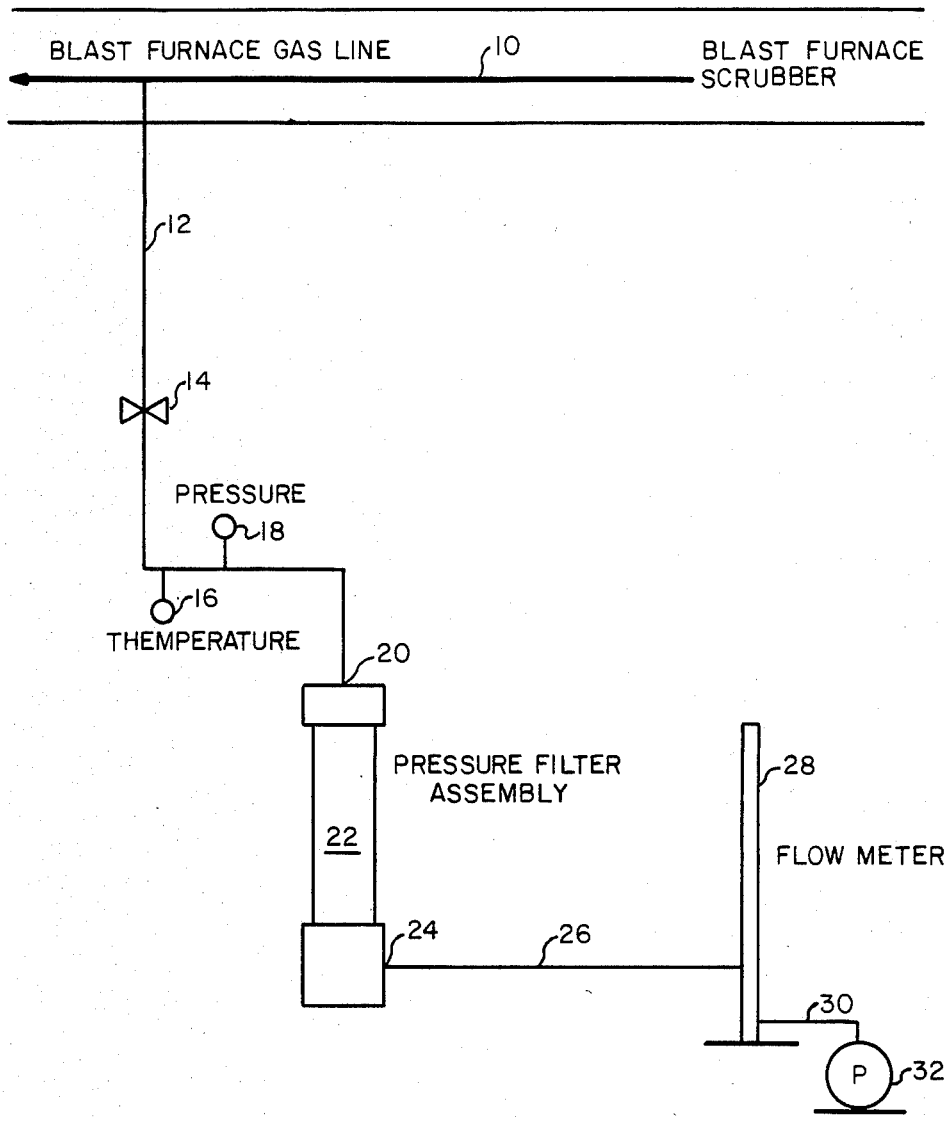

The manufacture of steel produces noxious gases which contain substantial quantities of particulate matter. It is now common practice to subject these particulate containing gases to wet gas scrubbing operations to remove most of the particulate matter from the gases before it is vented to the atmosphere. It is now common to employ chemical additives to treat the gases to improve the efficiency of the scrubbers.

It is often difficult to measure the efficiency of gas scrubbing systems. The present invention provides an apparatus and method for determining the efficiency of chemical additives used for improving the wet scrubbing of off-gases. It is preferably used in measuring scrubbing efficiency of blast furnace off-gases.

DRAWINGS

The drawing is a schematic of the apparatus used in the invention.

Specifically the drawing shows a blast furnace gas line 10 used to convey off-gas from a blast furnace scrubber. The gas line 10 is filled with a sample line 12 for withdrawing gas. This sample line is fitted with shut off valve 14.

Down stream from the valve is a temperature gauge 16 and a pressure gauge 18. After the gauge the sample line 12 goes into an inlet 20 of a pressure filter 22. The pressure filter is of a conventional design and contains a filter element (not shown) adapted to retain fine particulates. Such a filter element would be a Millipore filter paper. The outlet 24 of the pressure filter 22 is connected by means of line 26 to flow meter 28.

Optionally flow meter 28 is fitted with line 30 which connects to vacuum pump 32 which can aid in maintaining a constant flow rate in the system.

In operation the off-gas sample is collected and flows through line 12. The particulate matter is retained in the filter 22. It is important that the time for monitoring the sample be fixed and be long enough to allow sufficient particulate matter to deposit in the filter. The filter element is then weighed to determine the amount of particulate material collected. With no additives this would determine the "blank". After a scrubbing additive had been used a sample would again then be obtained as described above. Conditions would be maintained constant to duplicate the conditions of the "blank".

The sample collected with and without treatment would be compared to determine the amount and type of particulate matter. This would give a direct indication of efficiency of the treatment.

Expressed in another way the method of this invention comprises a method for determining gas scrubber efficiency in steel mill furnace off-gas systems which comprises the steps of:

(a) withdrawing a side stream sample from untreated gas flowing through an off-gas line, (b) passing said sample through a pressure filter for a fixed period of time whereby the particulate matter in the sample is collected, (c) withdrawing a side stream sample from the same off-gas line after chemical treatment has been added to the off-gas and pasing the treated sample through a pressure filter for the same fixed period of time used in step (b), whereby the particulate matter in the treated matter is collected.

(d) comparing the amount and types of samples collected in steps (b) and (c) to determine the efficiency of the treatment.

What is claimed is:

1. A method for determining the efficiency of chemical treatments used in gas scrubbers in steel mill furnace off-gas systems which comprises the steps of:

(a) withdrawing a side stream sample from untreated gas flowing through an off-gas line;

(b) passing said sample through a pressure filter for a fixed period of time at a constant flow rate whereby the particulate matter in the sample is collected, (c) withdrawing a side stream sample from the same off-gas line after chemical treatment has been added to the off-gas and passing the treated sample through a pressure filter at the same constant flow rate and for the same fixed period of time used in step (b), whereby the particulate matter in the treated matter is collected, (d) comparing the amount and types of samples collected in steps (b) and (c) to determine the efficiency of the treatment.

* * * * *